US010032443B2

(12) United States Patent
Braasch et al.

(10) Patent No.: US 10,032,443 B2
(45) Date of Patent: Jul. 24, 2018

(54) INTERACTIVE, EXPRESSIVE MUSIC ACCOMPANIMENT SYSTEM

(71) Applicant: RENSSELAER POLYTECHNIC INSTITUTE, Troy, NY (US)

(72) Inventors: Jonas Braasch, Latham, NY (US); Nikhil Deshpande, Emerson, NJ (US); Pauline Oliveros, Kingston, NY (US); Selmer Bringsjord, Troy, NY (US)

(73) Assignee: Rensselaer Polytechnic Institute, Troy, NY (US)

( * ) Notice: Subject to any disclaimer, the term of this patent is extended or adjusted under 35 U.S.C. 154(b) by 0 days.

(21) Appl. No.: 15/324,970

(22) PCT Filed: Jul. 10, 2015

(86) PCT No.: PCT/US2015/040015

§ 371 (c)(1),
(2) Date: Jan. 9, 2017

(87) PCT Pub. No.: WO2016/007899

PCT Pub. Date: Jan. 14, 2016

(65) Prior Publication Data

US 2017/0213534 A1 Jul. 27, 2017

Related U.S. Application Data

(60) Provisional application No. 62/022,900, filed on Jul. 10, 2014.

(51) Int. Cl.

| | |
|---|---|
| ***G10H 1/42*** | (2006.01) |
| ***G10H 1/38*** | (2006.01) |
| ***G10H 7/00*** | (2006.01) |

(52) U.S. Cl.

CPC ..... *G10H 1/42* (2013.01); *G10H 1/38* (2013.01); *G10H 2210/051* (2013.01);
(Continued)

(58) Field of Classification Search

CPC ..... G10H 1/42; G10H 1/38; G10H 2210/051; G10H 2210/076; G10H 2210/356; G10H 2210/576; G10H 2250/131
(Continued)

(56) References Cited

U.S. PATENT DOCUMENTS 3,629,480 A * 12/1971 Harris ..... G10H 1/42 84/713
3,951,029 A * 4/1976 Tsukamoto ..... G10H 1/28 84/667

(Continued)

FOREIGN PATENT DOCUMENTS

EP 0699333 A1 3/1996
EP 1081680 A1 7/2001

(Continued)

OTHER PUBLICATIONS

Braasch et al., "Caira—a creative artificially-intuitive and reasoning agent as conductor of telematic music improvisations," Proceedings of the 131st Audio Engineering Society Convention, Oct. 20-23, 2011, pp. 1-10, New York, NY.

(Continued)

*Primary Examiner* — David Warren
*Assistant Examiner* — Christina Schreiber
(74) *Attorney, Agent, or Firm* — Murtha Cullina LLP; Anthony P. Gangemi

(57) ABSTRACT

Systems and methods capable of providing adaptive and responsive accompaniment to music with fixed chord progressions, such as jazz and pop, are provided. A system can include one or more sound-capturing devices, a signal analyzer to analyze captured sound signals, and an electronic sound-producing component that produces electronic sounds as an accompaniment.

21 Claims, 11 Drawing Sheets

(52) U.S. Cl.
CPC . *G10H 2210/076* (2013.01); *G10H 2210/356* (2013.01); *G10H 2210/576* (2013.01); *G10H 2250/131* (2013.01)

(58) Field of Classification Search
USPC ..... 84/612
See application file for complete search history.

(56) References Cited

U.S. PATENT DOCUMENTS

| | | | | | |
|---|---|---|---|---|---|
| 4,300,430 | A * | 11/1981 | Bione | G10H 1/182 | 84/477 R |
| 4,506,580 | A * | 3/1985 | Koike | G10G 3/00 | 84/477 R |
| 4,864,908 | A * | 9/1989 | Kino | G10H 1/36 | 84/478 |
| 4,922,797 | A * | 5/1990 | Chapman | G10H 1/0066 | 84/650 |
| 5,177,313 | A * | 1/1993 | Miyamoto | G10H 1/40 | 84/611 |
| 5,741,992 | A * | 4/1998 | Nagata | G10H 1/10 | 434/307 A |
| 5,869,783 | A * | 2/1999 | Su | G10H 1/361 | 84/612 |
| 6,051,771 | A * | 4/2000 | Iizuka | G10H 1/28 | 84/622 |
| 6,975,995 | B2 * | 12/2005 | Kim | A63F 13/06 | 704/278 |
| 7,323,630 | B2 * | 1/2008 | Tsuge | G10H 1/0025 | 84/609 |
| 7,774,078 | B2 * | 8/2010 | Booth | H04R 5/04 | 381/103 |
| 8,017,853 | B1 * | 9/2011 | Rice | G04F 5/025 | 84/615 |
| 8,338,686 | B2 * | 12/2012 | Mann | G06F 3/0481 | 84/609 |
| 2001/0003944 | A1 * | 6/2001 | Okubo | G10H 1/0016 | 84/637 |
| 2009/0217805 | A1 * | 9/2009 | Lee | G10H 1/0025 | 84/611 |
| 2012/0295679 | A1 * | 11/2012 | Izkovsky | G09B 15/023 | 463/7 |
| 2014/0000440 | A1 * | 1/2014 | Georges | G10H 7/00 | 84/609 |
| 2014/0109752 | A1 * | 4/2014 | Hilderman | G10H 1/38 | 84/613 |
| 2014/0260913 | A1 * | 9/2014 | Matusiak | G10H 1/0025 | 84/613 |
| 2015/0127669 | A1 * | 5/2015 | Roy | G10H 1/361 | 707/755 |
| 2017/0213534 | A1 * | 7/2017 | Braasch | G10H 1/42 | |

FOREIGN PATENT DOCUMENTS

| | | | | |
|---|---|---|---|---|
| WO | 9535562 | A1 | 12/1995 | |
| WO | 03032295 | A1 | 4/2003 | |
| WO | 2013/182515 | | 12/2013 | |
| WO | 2014/086935 | | 6/2014 | |
| WO | WO 2016007899 | A1 * | 1/2016 | G10H 1/38 |

OTHER PUBLICATIONS

Braasch et al., "A spatial auditory display for telematic music performances," Principles and Applications of Spatial Hearing: Proceedings of the First International Workshop on IWPASH, May 13, 2011, pp. 1-16.

Chalupper et al., "Dynamic loudness model (DLM) for normal and hearing-impaired listeners," Acta Acustica United with Acustica, 2002, pp. 378-386, vol. 88.

Cope, "An expert system for computer-assisted composition," Computer Music Journal, Winter 1987, pp. 30-46, vol. 11, No. 4.

Gamper et al., "A performer-controlled live sound-processing system: new developments and implementations of the expanded instrument system," Leonardo Music Journal, 1998, pp. 33-38, vol. 8.

International Search Report/Written Opinion, International Application No. PCT/US2015/040015, PCT/ISA/210, PCT/ISA/220, PCT/ISA/237, dated Oct. 29, 2015.

Braasch et al., "A creative artificially-intuitive and reasoning agent in the context of live music improvisation," Music, Mind, and Invention Workshop: Creativity at the Intersection of Music and Computation, Mar. 30-31, 2012, pp. 1-4, The College of New Jersey.

Van Nort et al., "A system for musical improvisation combining sonic gesture recognition and genetic algorithms," Proceedings of the SMC 2009 6th Sound and Music Computing Conference, Jul. 23-25, 2009, pp. 131-136, Porto, Portugal.

Van Nort et al., "Developing systems for improvisation based on listening," Proceedings of the 2010 International Computer Music Conference, Jun. 1-5, 2010, pp. 1-8, New York, New York.

Van Nort et al., "Mapping to musical actions in the FILTER system," The 12th International Conference on New Interfaces for Musical Expression, May 21-23, 2012, pp. 1-4, Ann Arbor, Michigan.

Oliveros et al., "The expanded instrument system (EIS)," Proceedings of the 1991 International Computer Music Conference, 1991, pp. 404-407, Montreal, QC, Canada.

Assayag et al., "OMAX: the software improviser," 2012, pp. 1-26, http://repmus.ircam.fr/omax/home.

Dubnov, "Non-gaussian source-filter and independent components generalizations of spectral flatness measure," Proceedings of the 4th International Symposium on Independent Component Analysis and Blind Signal Separation (ICA2003), Apr. 2003, pp. 143-148, Nara, Japan.

Dubnov et al., "Structural and affective aspects of music from statistical audio signal analysis," Journal of the American Society for Information Science and Technology, 2006, pp. 1526-1536, vol. 57, No. 11.

Ellis, "Prediction-driven computational auditory scene analysis," Doctoral Dissertation, Jun. 1996, pp. 1-180, Massachusetts Institute of Technology.

Friberg, "Generative rules for music performance: a formal description of a rule system," Computer Music Journal, 1991, pp. 56-71, vol. 15, No. 2.

Jacob, "Algorithmic composition as a model of creativity," 1996, pp. 1-13, Advanced Computer Architecture Lab, EECS Department, University of Michigan, Ann Arbor, Michigan.

Lewis, "Too many notes: computers, complexity and culture in voyager," Leonardo Music Journal, 2000, pp. 33-39, vol. 10.

Russell et al., Artificial Intelligence: A Modern Approach, 2002, Third Edition, Prentice Hall, Upper Saddle River, New Jersey.

Pachet, "Beyond the cybernetic jam fantasy: the continuator," IEEE Computer Graphics and Applications, Jan. 2004, pp. 1-6, vol. 24, No. 1.

Widmer, "The synergy of music theory and AI: learning multi-level expressive interpretation," Technical Report, OEFAI-94-06, 1994, pp. 114-119, Austrian Research Institute for Artificial Intelligence.

* cited by examiner

INTERACTIVE, EXPRESSIVE MUSIC ACCOMPANIMENT SYSTEM

CROSS-REFERENCE TO RELATED APPLICATIONS

This application is a national stage application of International Patent Application No. PCT/US2015/040015, filed Jul. 10, 2015, which claims the benefit of U.S. Provisional Application Ser. No. 62/022,900, filed Jul. 10, 2014, both of which are incorporated herein by reference in their entireties.

GOVERNMENT SUPPORT

This invention was made with government support under NSF Creative IT Grant No. 1002851. The government has certain rights in the invention.

BACKGROUND OF INVENTION

Music accompaniment systems have a long tradition in electronic organs used by one-man bands. Typically, the automated accompaniment produces a rhythm section, such as drums, bass, or a harmony instrument (e.g., a piano). The rhythm section can perform in a given tempo (e.g., 120 beat-per-minute), style (e.g., bossa nova) and set of chords (e.g., recorded live with the left hand of the organ player). The accompaniment system can then create a bass line and rhythmical harmonic chord structure from the played chord and progressing chord structure. Similar systems, like Band-in a Box™, create a play-along band from a manually-entered chord sheet using a software synthesizer for drums, bass, and harmony instruments. Other approaches focus on classical music.

BRIEF SUMMARY

The subject invention provides novel and advantageous systems and methods, capable of providing adaptive and responsive accompaniment to music. Systems and methods of the subject invention can provide adaptive and responsive electronic accompaniment to music with fixed chord progressions, which includes but is not limited to jazz and popular (pop) music. A system can include one or more sound-capturing devices (e.g., microphone), a signal analyzer to analyze captured sound, an electronic sound-producing component that produces electronic sounds as an accompaniment, and a modification component to modify the performance of the electronic sound-producing component based on output of the signal analyzer. In some embodiments, a music synthesizer can be present to perform sonification.

In an embodiment, a system for accompanying music can include: a sound-signal-capturing device; a signal analyzer configured to analyze sound signals captured by the sound-signal-capturing device; and an electronic sound-producing component that produces a rhythm section accompaniment. The system can be configured such that the rhythm section accompaniment produced by the electronic sound-producing component is modified based on output of the signal analyzer.

In another embodiment, a system for analyzing timing and semantic structure of a verbal count-in of a song, the system can include: a sound-signal-capturing device; a signal analyzer configured to analyze sound signals of a human voice counting in a song captured by the sound-signal-capturing device; a word recognition system; and a count-in algorithm that tags timing and identified digits of the captured counting and uses this combined information to predict measure, starting point, and tempo for the song based on predetermined count-in styles.

DETAILED DESCRIPTION

Figure 1:
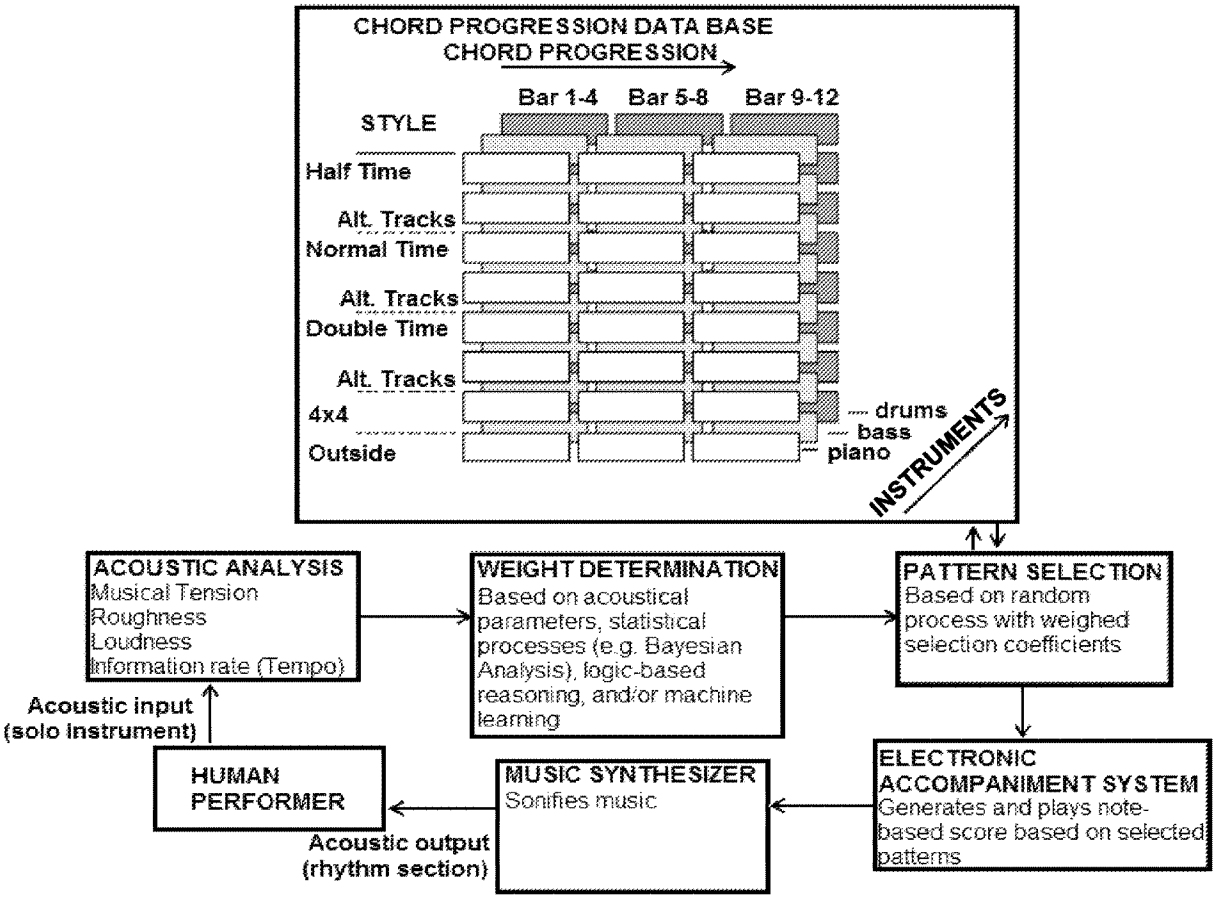
FIG. 1 shows a schematic view of a system according to an embodiment of the subject invention.

The subject invention provides novel and advantageous systems and methods, capable of providing adaptive and responsive accompaniment to music. Systems and methods of the subject invention can provide adaptive and responsive electronic accompaniment to music with fixed chord progressions, which includes but is not limited to jazz and popular (pop) music. A system can include one or more sound-capturing devices (e.g., microphone), a signal analyzer to analyze captured sound, an electronic sound-producing component that produces electronic sounds as an accompaniment, and a modification component to modify the performance of the electronic sound-producing component based on output of the signal analyzer. In some embodiments, a music synthesizer can be present to perform sonification.

It can be important in certain situations that an accompaniment system is able to adjust the tempo of the accompaniment (e.g., coded through a digital music score) to the soloist (e.g., adjust the tempo of a digital piano to a live violinist). Related art jazz and popular music accompany systems are not expressive. Band-in-a-Box™, for example, always performs the same accompaniment for a given chord structure, style sheet combination. In jazz, however, multiple players listen to each other and adjust their performance to the other players. For example, a good rhythm section will adjust its volume if the soloist plays with low intensity and/or sparse. Often, some of the rhythm instruments rest and only part of the band accompanies the soloist. In some cases, the band can go into double time if the soloist plays fast (e.g., sequences of 16th notes).

Double time involves playing twice the tempo while the duration of the chord progression remains the same (e.g., each chord can be performed twice as long in terms of musical measures). In half time, the tempo is half the original tempo and the chord progression can be half the original metric value. Impulses can also come from the rhythm section. The rhythm section can decide to enter double time, if the players believe the solo could benefit from some changes because the soloist keeps performing the same. The adaptive performance of a rhythm section can be a problem for a jazz student. Students are likely used to performing to the same rhythm section performance from practice, but then during a live performance, the band may change things up such that the student is thrown off because he or she is not used to unexpected changes in the accompaniment. Also, an experienced jazz player would likely find it quite boring to perform with a virtual, dead rhythm section that is agnostic to what is being played by the soloist.

Systems and methods of the subject invention can advantageously overcome the problems associated with related art devices. Systems and methods of the subject invention can listen to the performer(s) (e.g., using one or more microphones), capture acoustic and/or psychoacoustic parameters from the performer(s) (e.g., one or more instruments of the performer(s)), and react to these parameters in real time by making changes at strategic points in the chord progression (e.g., at the end of the chord structure or at the end of a number of bars, such as at the end of four bars). The parameters can include, but are not necessarily limited to, loudness (or volume level), information rate (musical notes per time interval), and a tension curve. The tension curve can be based on, for example, loudness, roughness, and/or information rate.

In many embodiments, a system can include one or more sound-capturing devices to capture sound from one or more performers (e.g., from one or more instruments and/or vocals from one or more performers). One or more of the sound-capturing devices can be a microphone. Any suitable microphone known in the art can be used. The system can further include a signal analyzer to analyze sound captured by the sound-capturing device(s). The signal analyzer can be, for example, a computing device, a processor that is part of a computing device, or a software program that is stored on a computing device and/or a computer-readable medium, though embodiments are not limited thereto. The system can further include an electronic sound-producing component that produces electronic sounds as an accompaniment. The electronic sound-producing component can be, for example, an electronic device having one or more speakers (this includes headphones, earbuds, etc.). The electronic device can include a processor and/or a computing device (which can include a processor), though embodiments are not limited thereto. The system can further include a modification component that modifies the performance of the electronic sound-producing component based on output of the signal analyzer. The modification component can be, for example, a computing device, a processor that is part of a computing device, or a software program that is stored on a computing device and/or a computer-readable medium, though embodiments are not limited thereto. In certain embodiments, two or more of the signal analyzer, the modification component, and the electronic sound-producing component can be part of the same computing device. In some embodiments, the same processor can perform the function of the signal analyzer and the modification part and may also perform some or all functions of the electronic sound-producing component.

The signal analyzer can analyze the captured sound/signals and measure and/or determine parameters from the captured sound/signals. The parameters can include, but are not necessarily limited to, loudness (or volume level), information rate (musical notes per time interval), and a tension curve. The tension curve can be based on, for example, loudness, roughness, and/or information rate. In one embodiment, the system can compute these parameters directly from an electronic instrument (e.g., by analyzing musical instrument digital interface (MIDI) data).

The modification part can then cause the electronic sound-producing component to react to the measured parameters in real time. This can include, for example, making changes at strategic points in the chord progression (e.g., at the end of the chord structure or at the end of a number of bars, such as at the end of four bars). The changes can include, but are not necessarily limited to: switching to double time if the information rate of the performer(s) exceeds an upper threshold; switching to half time if the information rate of the performer(s) is lower than a lower threshold; switching to normal time if the information rate of the performer(s) returns to a level in between the upper and lower threshold; adapting the loudness of the rhythm section instruments to the loudness and tension curve of the performer(s); playing outside the given chord structure if the system detects that the performer(s) is/are performing outside this structure; pausing instruments if the tension curve and/or loudness is very low; and/or performing 4×4 between the captured instrument and a rhythm section instrument by analyzing the temporal structure of the tension curve (e.g., analyzing gaps or changing in 4-bar intervals). In a 4×4, the instruments take solo turns every four bars.

In an embodiment, the modification part and/or the electronic sound-producing component (which, as discussed above, can be the same component in certain embodiments) can give impulses and take initiative based on a stochastic system. Such a stochastic system can use, e.g., a random generator. For each event, a certain threshold of chance (likelihood) can be adjusted and, if the internal drawn random number exceeds this threshold, the electronic sound-producing component takes initiative by, for example, changing the produced rhythm section accompaniment. The rhythm section accompaniment can be changed in the form of, for example: changing the style pattern, or taking a different pattern within the same style; pausing instruments; changing to double time, half time, or normal time; leading into the theme or other solos; playing 4×4; and/or playing outside.

In one embodiment, a system can omit the sound-capturing device and capture signals directly from an electronic instrument (e.g., MIDI data). In a particular embodiment, the signal analyzer can both capture signals and analyze the signals. The signal analyzer can also measure and/or determine parameters from the captured signals.

Figure 2:
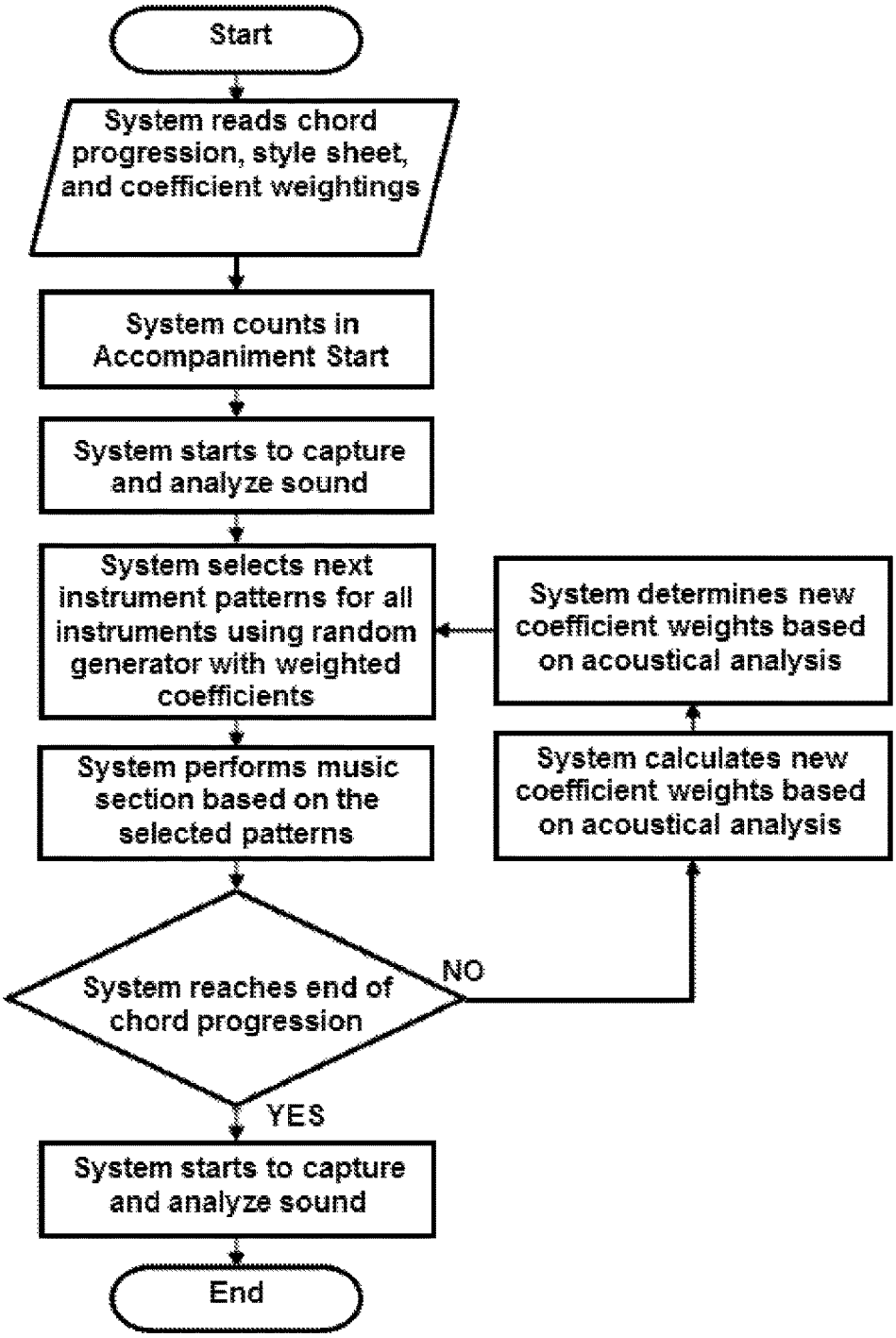
FIG. 2 shows a flow diagram for a system according to an embodiment of the subject invention.

In many embodiments, changes can be made at strategic points in the chord progression (e.g., at the end of the chord structure or at the end of a number of bars, such as at the end of four bars) using a stochastic algorithm (e.g., instead of being based on the measured/computed parameters). That is, the changes can be subject to chance, either in part or in whole. The signal analyzer, the modification part, and/or the electronic sound-producing component can run such a stochastic algorithm, leading to changes at strategic points in the chord progression. FIG. 1 shows a schematic view of a system according to such an embodiment, and FIG. 2 shows a flow diagram for a system according to such an embodiment. The changes can include, but are not necessarily limited to: switching to double time; switching to half time; switching to normal time; changing the loudness of the rhythm section instruments; playing outside the given chord structure; pausing instruments; and/or performing 4×4 between the captured instrument and a rhythm section instrument. In the case where the changes can be subject to chance in part, the likelihood of making a change can be influenced at least in part by the measured/computed parameters. For example, if the information rate of the performer(s) increases, the likelihood for the rhythm section to change to double time increases, but there is no absolute threshold. As another example, if the information rate of the performer(s) decreases, the likelihood for the rhythm section to change to half time increases, but there is no absolute threshold.

Referring to FIG. 1, the acoustic input can be one or more human performers. Though FIG. 1 lists the singular "performer" and the term "solo instrument", this is for demonstrative purposes only and should not be construed as implying that multiple performers and/or instruments cannot be present. Acoustic analysis can be performed (e.g., by the signal analyzer) to determine parameters such as the musical tension, roughness, loudness, and/or information rate (tempo). A weight determination can be made based on the parameters and using statistical processes (e.g., Bayesian analysis), logic-based reasoning, and/or machine learning. Then, pattern selection can be performed based on random processes with weighted selection coefficients. The weight determination and pattern selection can be performed by, for example, a modification component. The electronic sound-producing component (the box labeled "electronic accompaniment system") can generate and play a note-based score based on selected parameters, and a music synthesizer, which may be omitted, can perform sonification. The acoustic output can be generated by the electronic sound-producing component and/or the music synthesizer. The upper portion of FIG. 1 shows a visual representation of some of the features of the accompaniment that can be present depending on what pattern is selected and/or what changes are made.

Examples 1-3 herein show results for a system as depicted in FIGS. 1 and 2. In an alternative embodiment to that which makes decisions at selected decision points, an algorithm can also be implemented to have provisions to change things immediately. For example, a sound pressure level of a background band can be adjusted immediately to the sound pressure level of the instrument(s) of the performer(s).

Systems and methods of the subject invention can be used with many types of music. Advantageously, systems and methods of the subject invention can be used with music with fixed chord progressions, including but not limited to jazz and popular (pop) music. That is, in many embodiments, the system can be configured to provide adaptive, responsive electronic music accompaniment to music having fixed chord progressions, such as jazz and pop music. Classical music and electronic avant-garde music do not typically have fixed chord progressions. In certain embodiments, the system is configured such that it provides adaptive, responsive electronic music accompaniment to music having fixed chord progressions but not to music that does not have fixed chord progression. For example, in one embodiment, the system is configured such that it provides adaptive, responsive electronic music accompaniment to music having fixed chord progressions but not to classical or electronic avant-garde music. In classical music the score is fixed (note value, duration, note onset, instrumentation) but the tempo is varied (as is the volume to some extent). In jazz and pop music, the tempo is fixed in), but the accompanying musicians have great flexibility to vary their performance within the given chord structure. Consequently, other acoustical parameters than just tempo have to be analyzed, and the music accompaniment system has to do more than simply adjust tempo. The system must be able to vary the musical patterns of the accompanying band sound and select or compose the patterns in a logical flow to the intention of the performer(s) based on the acoustical analysis.

In an embodiment, of the subject invention, a system can include an algorithm (a "count-in algorithm") that recognizes a human talker counting in a song. The system can adapt the remainder of the system described herein (the sound-capturing device(s), the signal analyzer, modification component, and/or electronic sound-producing component) to start with the human performer in the right measure and tempo. The algorithm can be implemented by any component of the system (e.g., the sound-capturing device(s), the signal analyzer, modification component, and/or electronic sound-producing component) or by a separate component. For example, the algorithm can be implemented by a computing device, a processor that is part of a computing device, or a software program that is stored on a computing device and/or a computer-readable medium, though embodiments are not limited thereto. Such a processor, computing device, or software program can also implement one or more of the other functions of the system.

The count-in algorithm can rely on word recognition of digits, and it can tag the digits with the estimated onset times to determine the tempo of the song and its measure by understanding the syntax of different count-in styles through characteristic differences in the number sequence. For example, in jazz one can count in a 4/4 measure by counting the first bar with half notes ("1" and "2") and then counting the second bar in using quarter notes ("1", "2", "3", "4"). Based on the differences in these patterns, the algorithm can detect the correct one. It can also differentiate between different measures (e.g., 3/4 and 4/4). Based on the temporal differences, the algorithm can estimate the starting point of the song (e.g., the first note of the 3rd bar).

The count-in algorithm can be an extension of an approach to set a tempo by tapping the tempo on a button (e.g., a computer keyboard). The advantage of the system of the subject invention is that it can understand the grammar of counting in, and computer programs can be led much more robustly and flexibly by human performers. The system can also be used as a training tool for music students, as counting in a song is often not an easy task, especially under the stress of a live music performance.

A system including a count-in algorithm can include one or more sound-capturing devices (e.g., microphone(s)) to capture the voice of the person counting in, a first algorithm to segment and time stamp sound samples captured with the microphone, a word recognition system to recognize digits and other key words, and a second algorithm that can identify tempo, measure, and start time (based on, e.g., the pairs of time-stamps of onsets and recognized digits, and common music knowledge). The sound-capturing device(s) can be the same as or different from those that can be used to capture the sounds of the musical performer(s). The first algorithm, the word recognition system, and the second algorithm can each be implemented by a computing device, a processor that is part of a computing device, or a software program that is stored on a computing device and/or a computer-readable medium, though embodiments are not limited thereto. Such a processor, computing device, or software program can also implement one or more of the other functions of the system. Also, such a processor, computing device, or software program can also implement one or more of the first algorithm, the word recognition system, and the second algorithm (i.e., they can be implemented on the same physical device, can be split up, or can be partially split with two on the same device and one split off).

Figure 5:
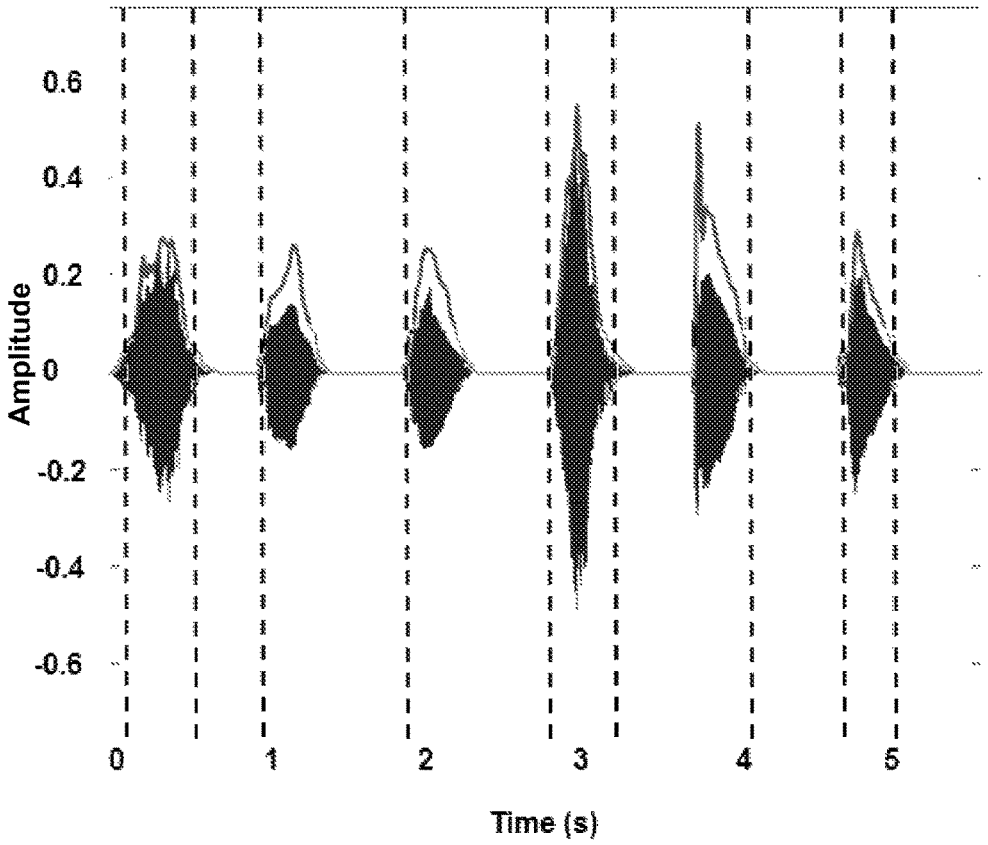
FIG. 5 shows a plot of amplitude versus time. The blue line (lower, clustered line) is for sound-file, and the red line (higher, separated line) is for envelope.

FIG. 1 shows a schematic view of a system including a count-in algorithm, and FIG. 2 shows a flow chart for such a system. Referring to FIGS. 1 and 2, when the system is activated ("Start") the system starts to analyze sound it receives from the sound-capturing device(s) that is/are ideally placed closely to the person who counts in. In this specific case, the system calculates the envelope on the microphone signal (e.g., by convolving the microphone signal with a 100-tab exponentially decaying curve at a sampling frequency of 44.1 kHz and then smoothing the signal further with a 10-Hz low pass filter, as shown in FIG. 5). When the system receives an onset, it can time stamp it and wait for the offset, then isolate the sound sample between on and offset and analyze it with the word recognition system. The system can wait for a cue word that starts the count-in process (e.g., the utterance "one"). The cue word can be predetermined or can be set ahead of time by a user of the system. Once the cue word is received, the system can wait for the next word, for example, the utterance "two" (this can also be predetermined or can be set ahead of time by a user).

Based on the time-stamped onsets of both words, the system can already make the first tempo estimation T in beats per minute (bpm), using the equation, $T=60/(t1-t2)$, where t1 is the onset time for the word "one" and t2 is the onset time for the word "two" (both values in seconds). Then the system can wait for the next recognized word. If this word is "one", the model can assume that a 4/4 measure will be counted in and the count-in style is two bars—the first bar with two counted in half notes ("one . . . two") and the second bar with counted in quarter notes ("one, two, three, four"). If instead, the system recognizes the word "three" the system will expect another count-in style, where both bars will be counted in, in quarter notes. In this case the system can wait for the fourth note and recognized word to discriminate between a 3/4 (in this case the fourth word should be "one") and 4/4 measure (in this case the fourth word should be the digit "four"). In the case of the 3/4 measure, the system would observe the next two recognized words ("two", "three") and their onsets, to determine the start time is of the pieces, which would occur one quarter note after the second utterance "three" at $ts=t3+60/T$. T is the tempo in bpm that can be estimated from the onset of the word utterances (e.g., from the average of the onset time difference between adjacent word utterances). The variable t3 represents the onset time of the second utterance "three". Examples 4-6 herein show specific cases for a system with a count-in algorithm.

A method according to the subject invention can include providing electronic musical accompaniment to one or more human performers using a system as described herein.

Unlike related art accompaniment systems for jazz or pop music, systems of the subject invention can advantageously respond to a human performer. In an embodiment, during the performance of a song, the signal analyzer can calculate acoustic parameters of the performer(s) in real-time. Weights can be adjusted according to these parameters, and these weights can then change the likelihood of a certain musical pattern to be selected by a random process. Other methods can be used to select the best musical pattern based on the performance of the performer(s) (e.g., logic-based reasoning or machine learning).

Systems and methods of the subject invention advantageously combine an acoustic analysis system (signal analyzer and/or modification component) to learn/understand which musical direction a human musician is going with an electronic music accompaniment device (electronic sound-producing component) that can respond to this and follow the direction of the performer(s). The system can also, or alternatively, give musical impulses itself.

Systems and methods of the subject invention can accompany a performer or performer(s) in a more natural way compared to related art systems. Similar to a good live band, the system can react to the performance of the performer(s). The system can also be used as a training tool for music students to learn to play songs or jazz standards with a dynamically changing band. Students who have not much experience with live bands but typically use play along tapes or systems like Band-in-a-Box™ often have difficulty when a live band produces something different from what has been rehearsed. A common problem is that the students then have difficulties following the chord progression. Systems of the subject invention can be used by students in training, in order to minimize the occurrence of these problems.

Systems of the subject invention can accompany one or more human musicians performing music (e.g., jazz or pop music, though embodiments are not limited thereto). The system can analyze the sound of the performer(s) to derive the musical intentions of the performer(s) and can adjust the electronic musical accompaniment to match the intentions of the performer(s). The system can detect features like double time and half time, and can understand the level of musical expression (e.g., low tension, high tension). Systems of the subject invention can be used for, e.g., training, home entertainment, one-man bands, and other performances.

The systems, methods, and processes described herein can be embodied as code and/or data. The software code and data described herein can be stored on one or more computer-readable media, which may include any device or medium that can store code and/or data for use by a computer system. When a computer system reads and executes the code and/or data stored on a computer-readable medium, the computer system performs the methods and processes embodied as data structures and code stored within the computer-readable storage medium.

It should be appreciated by those skilled in the art that computer-readable media include removable and non-removable structures/devices that can be used for storage of information, such as computer-readable instructions, data structures, program modules, and other data used by a computing system/environment. A computer-readable medium includes, but is not limited to, volatile memory such as random access memories (RAM, DRAM, SRAM); and non-volatile memory such as flash memory, various read-only-memories (ROM, PROM, EPROM, EEPROM), magnetic and ferromagnetic/ferroelectric memories (MRAM, FeRAM), and magnetic and optical storage devices (hard drives, magnetic tape, CDs, DVDs); network devices; or other media now known or later developed that is capable of storing computer-readable information/data. Computer-readable media should not be construed or interpreted to include any propagating signals.

The subject invention includes, but is not limited to, the following exemplified embodiments.

Embodiment 1

A system for accompanying music, comprising:

a sound-signal-capturing device;

a signal analyzer configured to analyze sound signals captured by the sound-signal-capturing device; and an electronic sound-producing component that produces a rhythm section accompaniment, wherein the system is configured such that the rhythm section accompaniment produced by the electronic sound-producing component is modified based on output of the signal analyzer.

Embodiment 2

The system according to embodiment 1, wherein the system is configured to produce a rhythm section accompaniment to accompany music having fixed chord progressions.

Embodiment 3

The system according to any of embodiments 1-2, wherein the sound-signal-capturing device is a microphone, wherein the signal analyzer is a processor or a computing device, and wherein the electronic sound-producing component is an electronic device having at least one speaker.

Embodiment 4

The system according to any of embodiments 1-3, wherein the signal analyzer is configured to measure parameters, of music performed by at least one human performer, from the captured sound signals, and wherein the parameters include at least one of loudness, information rate, and roughness, and tension of the music.

Embodiment 5

The system according to embodiment 4, wherein they system is configured to make a change, based on the measured parameter, at one or more strategic points in a chord progression of the rhythm section accompaniment produced by the electronic sound-producing component.

Embodiment 6

The system according to embodiment 6, wherein the change includes at least one of: switching to double time if the information rate of the exceeds an upper threshold; switching to half time if the information rate is lower than a lower threshold; switching to normal time if the information rate returns to a level in between the upper threshold and the lower threshold; adapting the loudness of the rhythm section accompaniment instruments to the loudness and tension curve of the at least one performer; playing outside a predetermined chord structure if the system detects that the at least one performer is performing outside the predetermined chord structure; pausing instruments of the rhythm section accompaniment if the tension or loudness decreases by a predetermined amount; and performing 4×4 between the captured music and an instrument of the rhythm section by analyzing a temporal structure of the tension.

Embodiment 7

The system according to any of embodiments 5-6, wherein the strategic points in the chord progression include at least one of: at the end of a chord structure; or at the end of a number of bars.

Embodiment 8

The system according embodiment 7, wherein the number of bars is four.

Embodiment 9

The system according to any of embodiments 1-8, wherein the system is configured to make a change, based on a stochastic process, at one or more strategic points in a chord progression of the rhythm section accompaniment produced by the electronic sound-producing component.

Embodiment 10

The system according to embodiment 9, wherein the change includes at least one of: switching to double time; switching to half time; switching to normal time; changing the loudness of the rhythm section accompaniment instruments; playing outside a predetermined chord structure; pausing instruments of the rhythm section accompaniment; and performing 4×4 between the captured music and an instrument of the rhythm section accompaniment.

Embodiment 11

The system according to any of embodiments 9-10, wherein the stochastic process uses a random generator, wherein, for a given event, a threshold of likelihood is adjusted and, if an internally-drawn random number exceeds the threshold of likelihood, a change is made.

Embodiment 12

The system according to any of embodiments 9-11, wherein the system is configured to make a change based on the stochastic process in combination with the measured parameters, such that values of the measured parameters affect the likelihood of the stochastic process causing a change to be made.

Embodiment 13

The system according to any of embodiments 9-12, wherein the system is configured to give an impulse and make an initiative change in the rhythm section accompaniment based on a stochastic process, wherein the initiative change is at least one of: changing a style pattern or taking a different pattern within the same style; pausing instruments of the rhythm section accompaniment; changing to double time, half time, or normal time; leading into a theme or a solo; playing 4×4; and playing outside.

Embodiment 14

The system according to any of embodiments 1-8, wherein the system is configured to make a change, based on a machine learning algorithm, at one or more strategic points in a chord progression of the rhythm section accompaniment produced by the electronic sound-producing component.

Embodiment 15

The system according to embodiment 14, wherein the change includes at least one of: switching to double time; switching to half time; switching to normal time; changing the loudness of the rhythm section accompaniment instruments; playing outside a predetermined chord structure; pausing instruments of the rhythm section accompaniment; and performing 4×4 between the captured music and an instrument of the rhythm section accompaniment.

Embodiment 16

The system according to any of embodiments 14-15, wherein the machine learning algorithm uses a random generator, wherein, for a given event, a threshold of likelihood is adjusted and, if an internally-drawn random number exceeds the threshold of likelihood, a change is made.

Embodiment 17

The system according to any of embodiments 14-16, wherein the system is configured to make a change based on the machine learning algorithm in combination with the measured parameters, such that values of the measured parameters affect the likelihood of the machine learning algorithm causing a change to be made.

Embodiment 18

The system according to any of embodiments 14-17, wherein the system is configured to give an impulse and make an initiative change in the rhythm section accompaniment based on a machine learning algorithm, wherein the initiative change is at least one of: changing a style pattern or taking a different pattern within the same style; pausing instruments of the rhythm section accompaniment; changing to double time, half time, or normal time; leading into a theme or a solo; playing 4×4; and playing outside.

Embodiment 19

The system according to any of embodiments 1-18, wherein the sound-signal-capturing device is configured to capture electronic signals directly from one or more electronic instruments.

Embodiment 20

The system according to any of embodiments 1-19, further comprising a music synthesizer to perform sonification on the rhythm section accompaniment produced by the electronic sound-producing component.

Embodiment 21

The system according to any of embodiments 1-20, wherein the system is configured to recognize a human voice counting in a song and start the rhythm section accompaniment in the right measure and tempo based on the counting of the human voice.

Embodiment 22

The system according to embodiment 21, wherein the sound-signal-capturing device captures the counting of the human voice, wherein the signal analyzer analyzes the captured counting, and wherein the system further comprises:

a word recognition component to recognize the captured counting; and a count-in algorithm that tags timing and identified digits of the captured counting and uses this combined information to predict measure, starting point, and tempo for the rhythm section accompaniment based on predetermined count-in styles.

Embodiment 23

The system according to embodiment 22, comprising a first computer-readable medium having computer-executable instructions for performing the count-in algorithm, and a second computer-readable medium having the word recognition component stored thereon.

Embodiment 24

The system according to embodiment 22, comprising a computer-readable medium having the word recognition component stored thereon, and also having computer-executable instructions for performing the count-in algorithm.

Embodiment 25

The system according to any of embodiments 22-24, wherein the system uses an envelope follower and threshold detector to mark onset of the captured counting to count in the rhythm section accompaniment.

Embodiment 26

The system according to any of embodiments 22-25, wherein the system uses Boolean Algebra based on different count-in style templates to predict measure, starting point, and tempo for the rhythm section accompaniment.

Embodiment 27

The system according to any of embodiments 1-18 and 20-26, comprising a plurality of sound-signal-capturing devices.

Embodiment 28

A system for analyzing timing and semantic structure of a verbal count-in of a song, the system comprising:

a sound-signal-capturing device;

a signal analyzer configured to analyze sound signals of a human voice counting in a song captured by the sound-signal-capturing device;

a word recognition system; and a count-in algorithm that tags timing and identified digits of the captured counting and uses this combined information to predict measure, starting point, and tempo for the song based on predetermined count-in styles.

Embodiment 29

The system according to embodiment 28, comprising a first computer-readable medium having computer-executable instructions for performing the count-in algorithm, and a second computer-readable medium having the word recognition component stored thereon.

Embodiment 30

The system according to embodiment 28, comprising a computer-readable medium having the word recognition component stored thereon, and also having computer-executable instructions for performing the count-in algorithm.

Embodiment 31

The system according to any of embodiments 28-30, wherein the system uses an envelope follower and threshold detector to mark onset of the captured counting to count in the song.

Embodiment 32

The system according to any of embodiments 28-31, wherein the system uses Boolean Algebra based on different count-in style templates to predict measure, starting point, and tempo for the song.

Embodiment 33

The system according to any of embodiments 28-32, comprising a plurality of sound-signal-capturing devices.

Embodiment 34

The system according to any of embodiments 28-33, wherein each signal-capturing device is a microphone.

Embodiment 35

The system according to any of embodiments 28-34, further comprising an electronic sound-producing component that plays the song.

Embodiment 36

The system according to embodiment 35, wherein the electronic sound-producing component is an electronic device having at least one speaker.

Embodiment 37

The system according to any of embodiments 14-17 wherein, instead of a machine learning algorithm, the change is based on logic reasoning.

Embodiment 38

The system according to any of embodiments 1-37, wherein the system is configured to perform changes and/or patterns typical for jazz music (e.g., 4×4, half time, double time, ending).

Embodiment 39

The system according to any of embodiments 1-38, wherein the system is configured to take voice commands from a performer to count in tempo, 4×4, and indicate the theme.

Embodiment 40

The system according to any of embodiments 1-39, wherein the system is configured to take visual commands from a performer to count in tempo, 4×4, and indicate the theme.

Embodiment 41

The system according to any of embodiments 1-40 wherein the system is configured to give voice commands from a performer to count in tempo, 4×4, and indicate the theme.

Embodiment 42

The system according to any of embodiments 1-41, wherein the system is configured to give visual commands from a performer to count in tempo, 4×4, and indicate the theme.

Embodiment 43

A system for accompanying music, comprising:

a) an electronic music accompany system that produces electronic sounds based on a digital score and/or chord progression;

b) one or more microphones to capture the sound of one or more musical instruments;

c) a signal analyzer to analyze the captured microphone sound; and d) a system to modify the performance of the electronic music accompaniment system based on the output of the signal analyzer.

Embodiment 44

The system according to embodiment 43, wherein the microphone and attached signal analyzer is replaced with an analyzer to analyze the output of an electronic music instrument or a plurality of thereof.

Embodiment 45

The system according to any of embodiments 43-44, wherein a plurality of microphones are closely positioned to a one musical instrument each to analyze the instruments individually.

Embodiment 46

The system according to any of embodiments 43-45, wherein the music accompaniment system performance is modified in terms of switching tempo and chord duration, loudness, and/or style based on the signal analyzer output.

Embodiment 47

The system according to any of embodiments 43-46, wherein the music accompaniment system is designed for popular music and/or jazz music.

Embodiment 48

The system according to any of embodiments 43-47, wherein the music accompaniment system is based on rhythmic chord progressions.

Embodiment 49

The system according to any of embodiments 43-48, wherein the modification of the music accompaniment system performance is influenced and/or driven by a stochastic process.

Embodiment 50

The system according to any of embodiments 43-48, wherein a machine learning algorithm or plurality of thereof is used to modify the music accompaniment.

Embodiment 51

The system according to any of embodiments 43-48, wherein logic reasoning is used to modify the music accompaniment.

Embodiment 52

The system according to any of embodiments 43-48, wherein the music accompaniment system performance is modified in terms of switching tempo and chord duration, loudness, and/or style based on the signal analyzer output using a combination of machine learning, random processes and/or logic based reasoning.

Embodiment 53

The system according to any of embodiments 43-52, wherein the acoustic analysis is based on a combination of information rate, loudness, and/or musical tension.

Embodiment 54

The system according to any of embodiments 43-53, wherein the system is configured to perform changes and/or patterns typical for jazz music 12 (e.g., 4×4, halftime, double time, ending)

Embodiment 55

The system according to any of embodiments 43-54, wherein the system is configured to take voice commands from the soloist to count in tempo, 4×4, and indicate the theme.

Embodiment 56

The system according to any of embodiments 43-55, wherein the system is configured to take visual commands from the soloist to count in tempo, 4×4, and indicate the theme.

Embodiment 57

The system according to any of embodiments 43-56, wherein the system is configured to give voice commands from the soloist to count in tempo, 4×4, and indicate the theme.

Embodiment 58

The system according to any of embodiments 43-57, wherein the system is configured to give visual commands from the soloist to count in tempo, 4×4, and indicate the theme.

Embodiment 59

The system according to any of embodiments 1 and 3-27, wherein the system is configured to produce a rhythm section accompaniment to accompany music having fixed or varied chord progressions.

Embodiment 60

The system according to any of embodiments 1-27 and 59, wherein the system is configured to produce a rhythm section accompaniment to accompany jazz or pop music.

Embodiment 61

A method of providing musical accompaniment, comprising using the system of any of embodiments 1-60.

Embodiment 62

A method of providing musical accompaniment, comprising:

playing music within functional range of the sound-signal-capturing device of the system of any of embodiments 1-60; and using the system to provide a rhythm section accompaniment to the played music.

Embodiment 63

The method according to any of embodiments 61-62, wherein the musical accompaniment is provided to music having fixed chord progressions.

Embodiment 64

The method according to any of embodiments 61-62, wherein the musical accompaniment is provided to jazz or pop music.

Embodiment 65

A method of analyzing timing and semantic structure of a verbal count-in of a song, comprising using the system of any of embodiments 28-36.

Embodiment 66

A method of analyzing timing and semantic structure of a verbal count-in of a song, comprising:

counting in a song within functional range of the sound-signal-capturing device of the system of any of embodiments 28-36; and using the system to analyze timing and semantic structure of the count-in of the song and then being playing the song.

A greater understanding of the present invention and of its many advantages may be had from the following examples, given by way of illustration. The following examples are illustrative of some of the methods, applications, embodiments and variants of the present invention. They are, of course, not to be considered as limiting the invention. Numerous changes and modifications can be made with respect to the invention.

Example 1

Figure 8A:
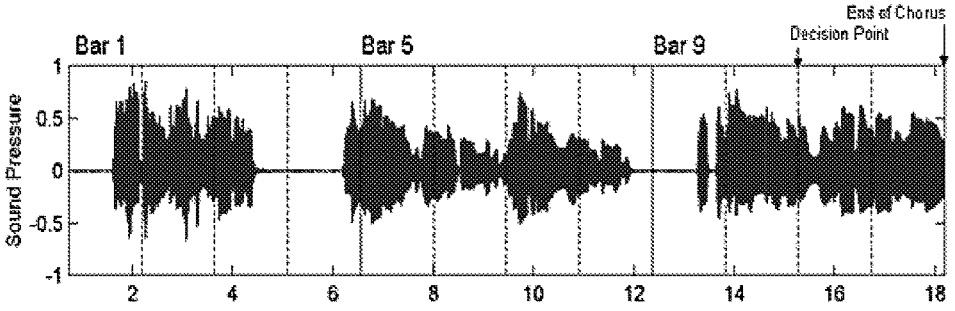
FIG. 8A shows a plot of sound pressure versus time.

A system as depicted in FIGS. 1 and 2 was tested using a chorus of a saxophone blues improvisation in F at 165 beats per minute (bpm). FIG. 8A shows a plot of sound pressure versus time for this chorus. The signal is that of a soprano saxophone recorded with a closely-positioned microphone. The vertical lines show the beginning of each bar, and the x-axis is the time in seconds.

Figure 8B:
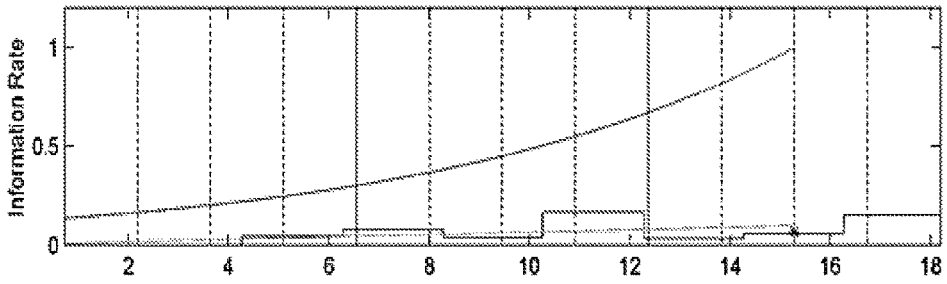
FIG. 8B shows a plot of information rate versus time.

FIG. 8B shows a plot of information rate versus time for the saxophone signal (blue, stepped line). The information rate was that as defined in Braasch et al. (J. Braasch, D. Van Nort, P. Oliveros, S. Bringsjord, N. Sundar Govindarajulu, C. Kuebler, A. Parks, A creative artificially-intuitive and reasoning agent in the context of live music improvisation, in: Music, Mind, and Invention Workshop: Creativity at the Intersection of Music and Computation, Mar. 30 and 31, 2012, The College of New Jersey, URL: http://www.tcnj.edu/mmi/proceedings.html2012; hereinafter referred to as "Braasch 2012"), which is incorporated herein by reference in its entirety. The information rate was the number of counted different musical notes per time interval. The information rate was scaled between 0 and 1, with increasing values the more notes that were played. It can be seen that the information rate was quite low, because not many notes were played in the first chorus.

Figure 8C:
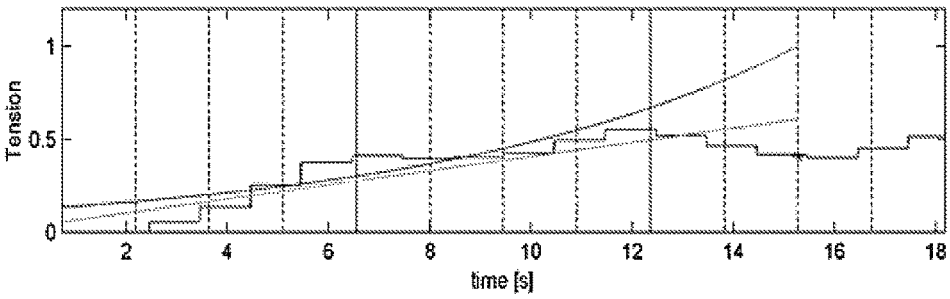
FIG. 8C shows a plot of tension versus time.

FIG. 8C shows a plot of tension versus time for the saxophone signal (stepped line) that was calculated using the following equation:

$$T=L+0.5\cdot((1-b)\cdot R+b\cdot I+O)),$$

where I is the information rate, and O is the onset rate. All parameters, L, R, I, and O, were normalized between 0 and 1, and the exponential relationships between the input parameters and T were also factored into these variables (Braasch 2012). Both the information rate and tension values were fairly low, which increases the likelihood that the music system will enter half-time mood and drop the harmony instrument in the next chorus. Two different methods can be used to calculate information rate and tension at the decision point, either by multiplying the curve with an exponential filter (red curve) or via linear regression (green line). The decision point is marked with a black asterisk in both FIGS. 8B and 8C, at the vertical dotted line between the 14-second and 16-second marks. The red curve is the higher, curved line in each of FIGS. 8B and 8C, and the green line is the lower line in each of FIGS. 8B and 8C.

Figure 11A:
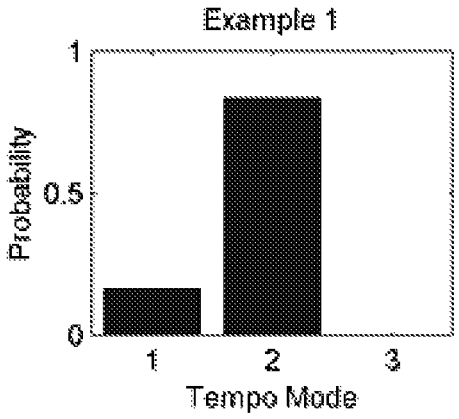
FIG. 11A shows a probability plot for different tempos.

The likelihood that the accompaniment system will be set to each of half time, normal time, or double time can be determined by the following equation to determine the switch function:

$$S=0.5*(I+T-1)+0.8*g,$$

where I is the information rate, T is the tension value, and g is a uniform random number between 0 and 1. For values of S<0, the tempo mode will be set to half time; for values of 0<=S<=1, the tempo mode will be set to normal tempo; and for values of S>1, the tempo mode will be set to double time. FIG. 11A shows the likelihood for different tempos using the linear regression method (on the x-axis, "1"=half time; "2"=normal time; and "3"=double time). Given the low values for the tension curve and information rate, the system will never shift into double time ("3"). The probability for entering half time is about 10%, and in about 90% of the cases the system will choose normal time.

A similar method can be used to select if a harmony instrument is being dropped:

$$S=0.1+0.5*(I+T-1)+0.75*g.$$

Figure 12:
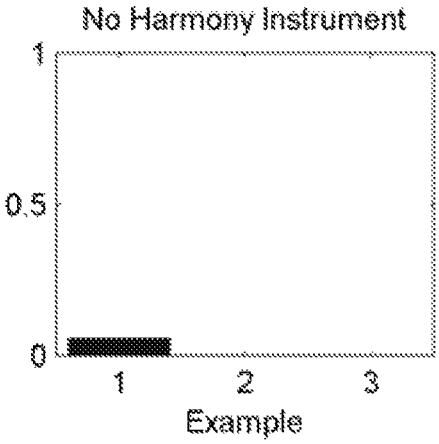
FIG. 12 shows a probability plot for removing a harmony instrument.

The system will drop the harmony instrument if S<0. FIG. 12 shows a probability plot depicting whether the harmony instrument will be dropped; the y-axis is probability (from 0 to 1). Referring to FIG. 12, it can be seen that for this example (Example 1), the probability that the harmony instrument will be dropped is very low (<5%).

Example 2

Figure 9A:
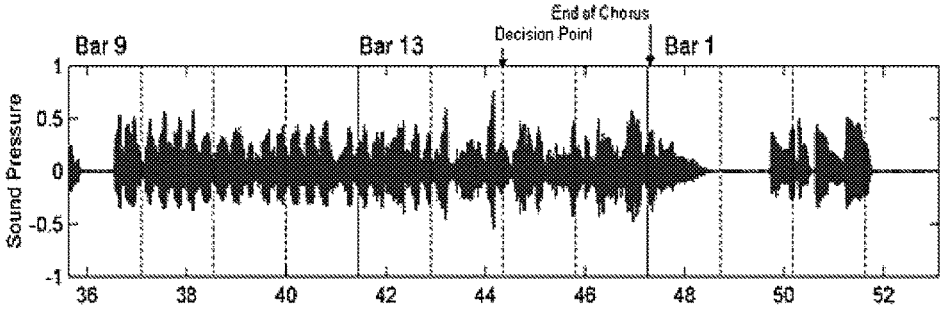
FIG. 9A shows a plot of sound pressure versus time.

The test of Example 1 was performed again using a different chorus at a different tempo. FIG. 9A shows a plot of sound pressure versus time for this chorus of saxophone blues improvisation. The signal is that of a soprano saxophone recorded with a closely-positioned microphone. The vertical lines show the beginning of each bar, and the x-axis is the time in seconds.

Figure 9B:
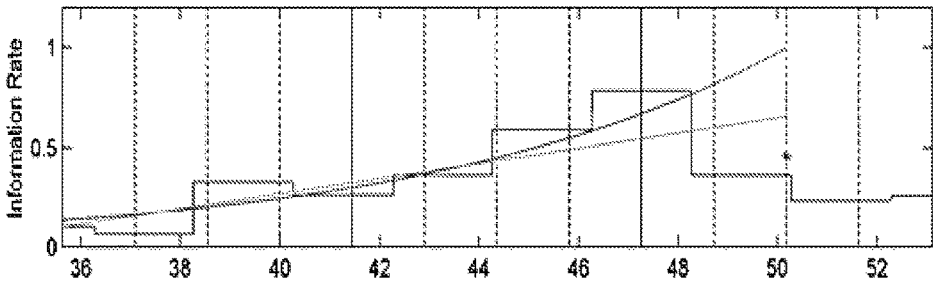
FIG. 9B shows a plot of information rate versus time.
Figure 9C:
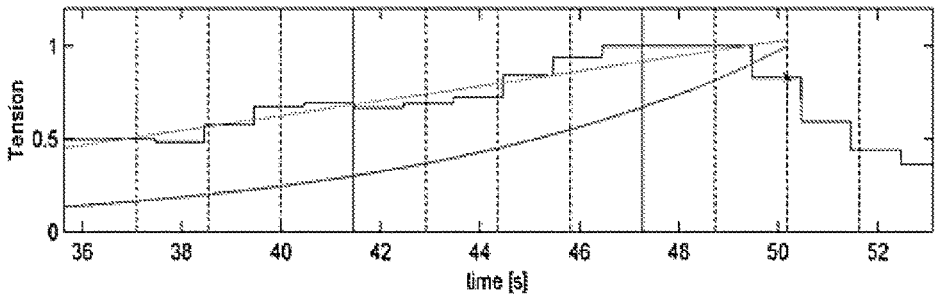
FIG. 9C shows a plot of tension versus time.

FIGS. 9B and 9C show plots of information rate and tension, respectively, both versus time, for the saxophone signal (blue, stepped line). The decision point is marked with a black asterisk in both FIGS. 9B and 9C, at the vertical dotted line between the 50-second and 52-second marks. Two different ways to calculate tension and information rate at the decision point are shown—multiplying the curve with an exponential filter (red curve) or via linear regression (green line). The red curve is the curved line that is higher at the decision point in FIG. 9B, and the green line is the line that is lower at the decision point. In FIG. 9C, the red curve is the lower, curved line, and the green line is the higher line.

Figure 11B:
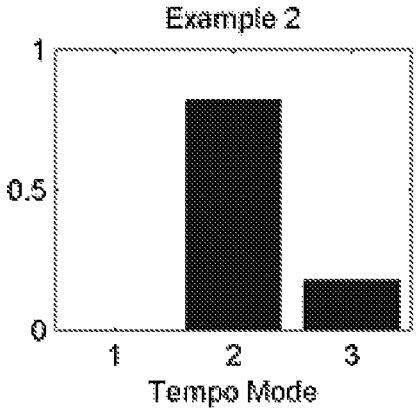
FIG. 11B shows a probability plot for different tempos.

Referring to FIG. 11B, it is very unlikely (~0%) that the system will enter half time ("1"), but there is a higher probability than in Example 1 that the system will enter double time ("3"). Normal time remains the highest probability. Referring to FIG. 12, there is an extremely low probability (~0) that the harmony instrument will be dropped in this example (Example 2).

Example 3

Figure 10A:
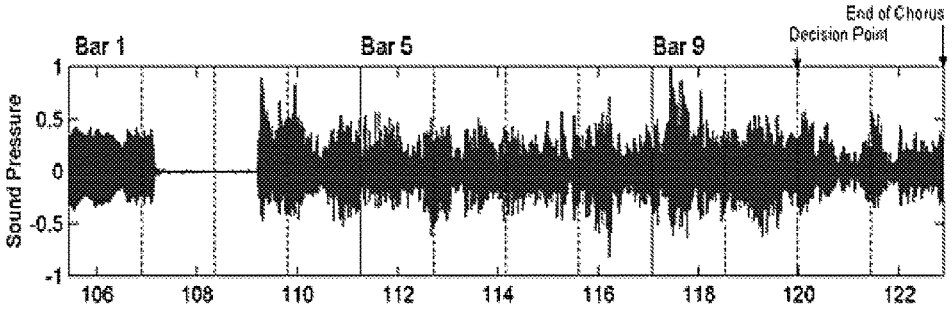
FIG. 10A shows a plot of sound pressure versus time.

The test of Examples 1 and 2 was performed again using a different chorus at a different tempo. FIG. 10A shows a plot of sound pressure versus time for this chorus of saxophone blues improvisation. The signal is that of a soprano saxophone recorded with a closely-positioned microphone. The vertical lines show the beginning of each bar, and the x-axis is the time in seconds.

Figure 10B:
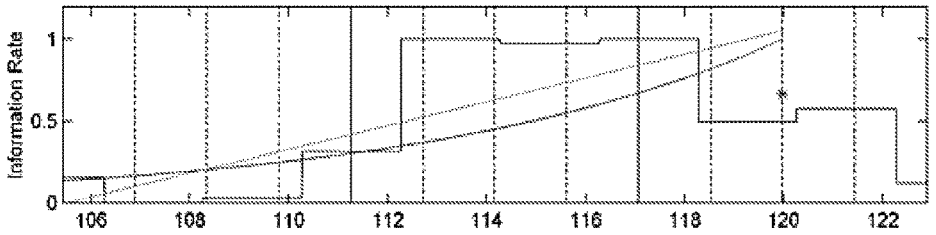
FIG. 10B shows a plot of information rate versus time.
Figure 10C:
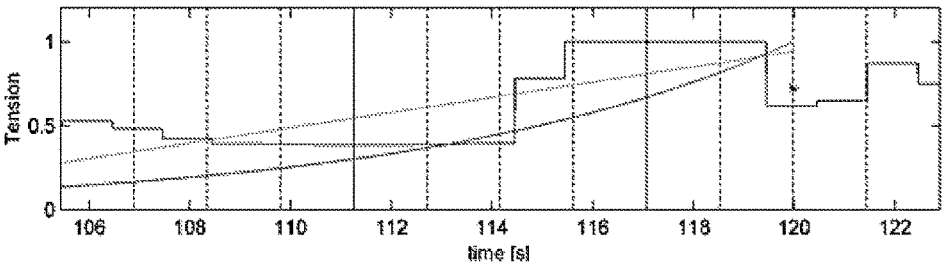
FIG. 10C shows a plot of tension versus time.

FIGS. 10B and 10C show plots of information rate and tension, respectively, both versus time, for the saxophone signal (blue, stepped line). The decision point is marked with a black asterisk in both FIGS. 10B and 10C, at the vertical dotted line at or around the 120-second mark. Two different ways to calculate tension and information rate at the decision point are shown—multiplying the curve with an exponential filter (red curve) or via linear regression (green line). The red curve is the curved line that is lower at the decision point in FIG. 10B, and the green line is the line that is higher at the decision point. In FIG. 10C, the red curve is the lower, curved line for the majority of the plot, though it is slightly higher at the decision point, and the green line is the lower line for the majority of the plot, though it is slightly lower at the decision point.

Figure 11C:
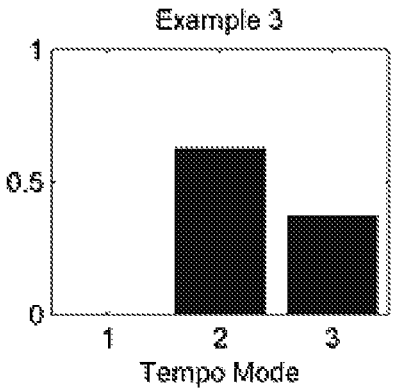
FIG. 11C shows a probability plot for different tempos.

Referring to FIG. 11C, it is very unlikely (~0%) that the system will enter half time ("1"), but there is a reasonable probability, higher than in Examples 1 or 2, that the system will enter double time ("3"). Normal time remains the highest probability. Referring to FIG. 12, there is an extremely low probability (~0) that the harmony instrument will be dropped in this example (Example 3).

Example 4

Figure 3:
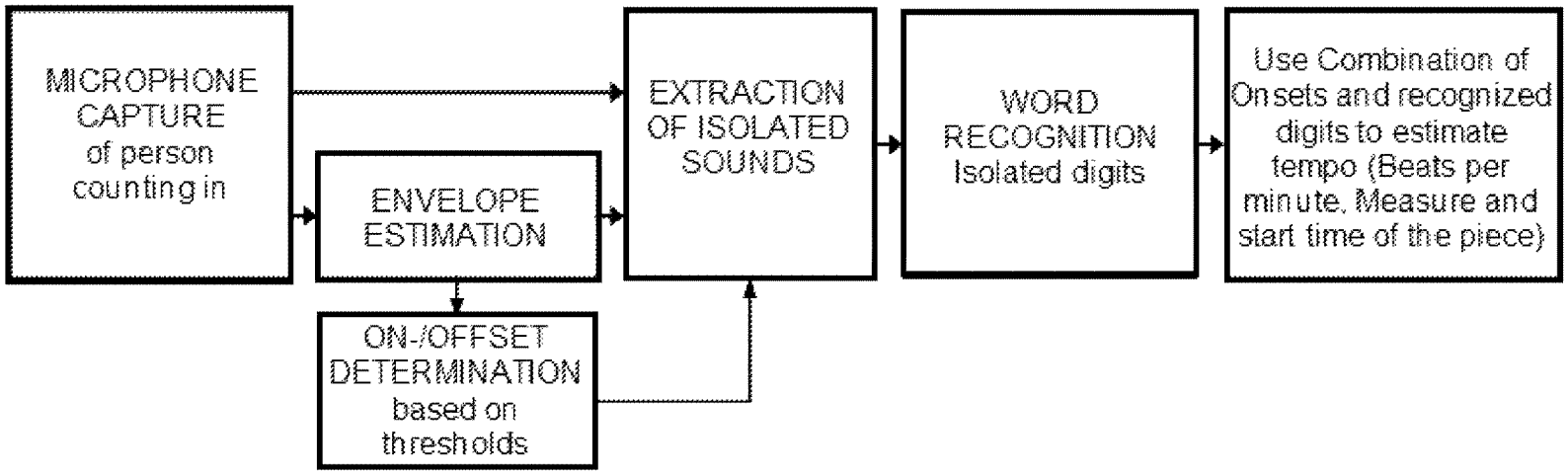
FIG. 3 shows a schematic view of a system according to an embodiment of the subject invention.
Figure 4:
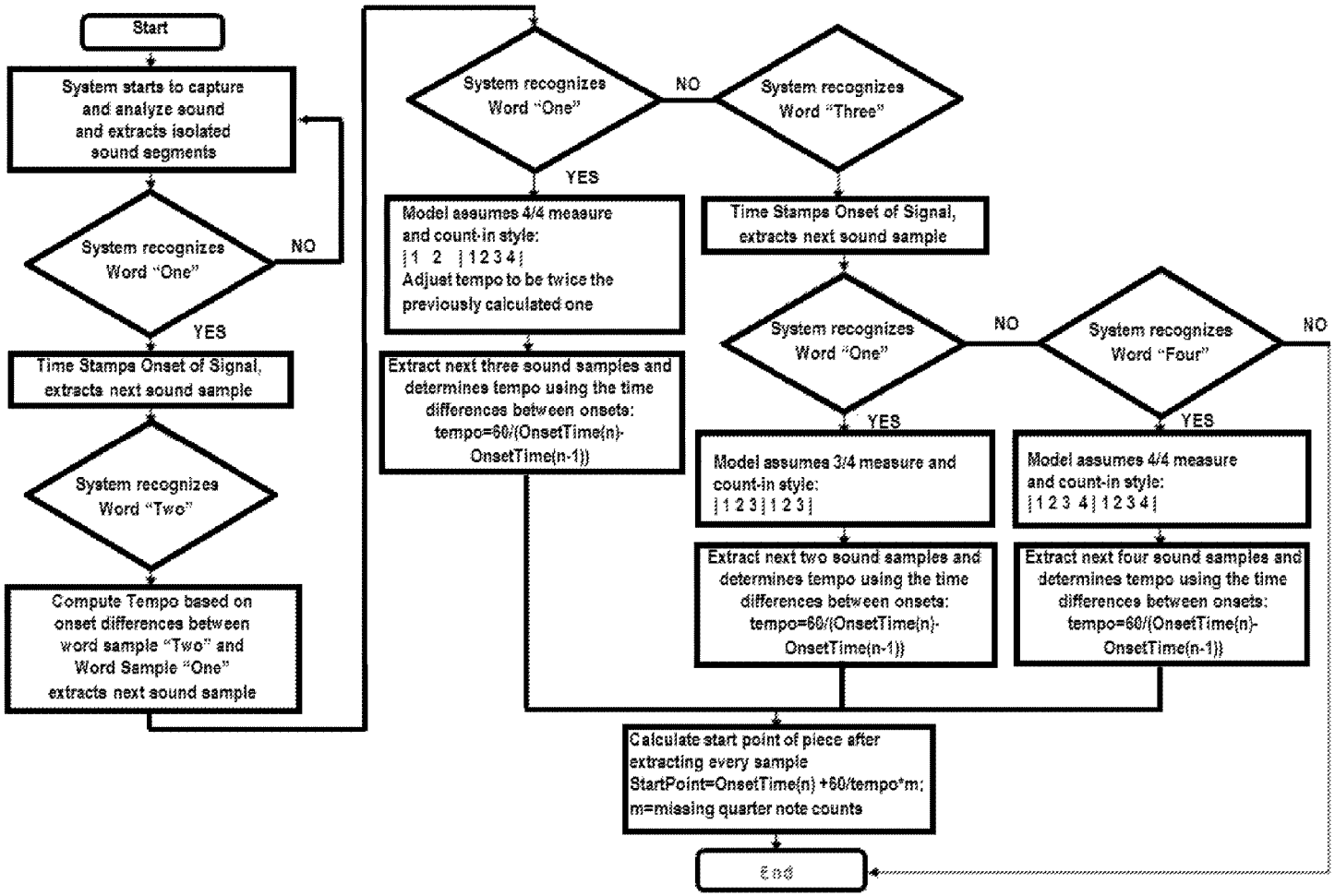
FIG. 4 shows a flow diagram for a system according to an embodiment of the subject invention.

The system of FIGS. 3 and 4 (with a "count-in" algorithm) was tested. The beat was 3/4 beat at 100 bpm, 3.6-s start time and count-in style of [1 2 3| 1 2 3]. FIG. 5 shows a plot of amplitude versus time for this 3/4 beat at 100 bpm, 3.6-s start time and count-in style [1 2 3| 1 2 3]. The blue line (lower, clustered line) is for sound-file, and the red line (higher, separated line) is for envelope.

Estimates are as follows:

Estimate @ 1.84 s: Measure: 3/4;
Estimate @ 1.84 s: Count-in style [1 2 3| 1 2 3];
Estimate @ 1.84 s: 3.53-s start time, 106 bpm;
Estimate @ 2.39 s: 3.52-s start time, 107 bpm; and
Estimate @ 3.06 s: 3.64-s start time, 103 bpm.

In this case, the system detected a 3/4 measure with the two-bar quarter-notes count-in style. The song start would be expected after the second utterance of the digit "three" at the time at ts=t4+60/T, where t4 is the onset time of the second utterance of "three".

Example 5

Figure 6:
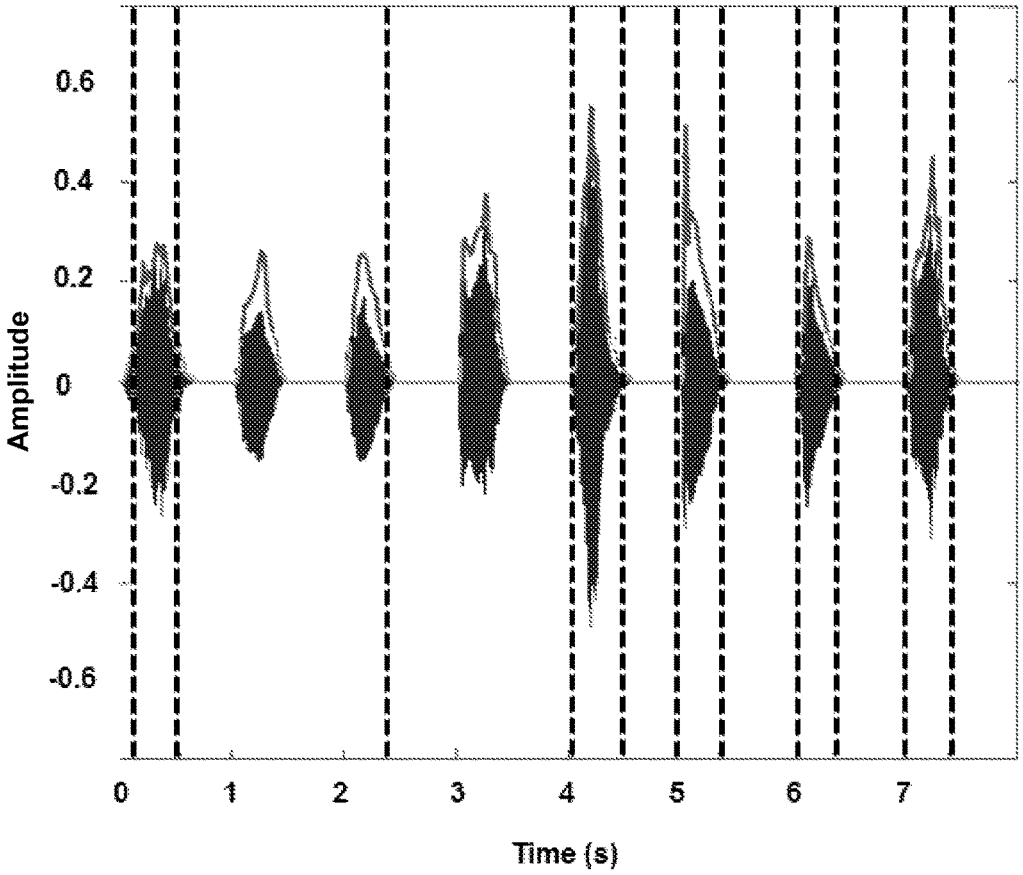
FIG. 6 shows a plot of amplitude versus time. The blue line (lower, clustered line) is for sound-file, and the red line (higher, separated line) is for envelope.

The test of Example 4 was repeated but with a 4/4 beat at 60 bpm, 8-s start time and count-in style of [1 2 3 4| 1 2 3 4]. FIG. 6 shows a plot of amplitude versus time for this 4/4 beat at 60 bpm, 8-s start time and count-in style [1 2 3 4| 1 2 3 4]. The blue line (lower, clustered line) is for sound-file, and the red line (higher, separated line) is for envelope.

Estimates are as follows:

Estimate @ 3.01 s: Measure: 4/4;
Estimate @ 3.01 s: Count-in style [1 2 3 4| 1 2 3 4];
Estimate @ 3.01 s: 7.81-s start time, 62.5 bpm;
Estimate @ 4.04 s: 7.95-s start time, 61.4 bpm;
Estimate @ 4.98 s: 7.89-s start time, 61.9 bpm;
Estimate @ 6.06 s: 8.04-s start time, 60.8 bpm; and
Estimate @ 7.02 s: 8.01-s start time, 61 bpm.

In this case, the system detected a 4/4 measure with the two-bar half-note/quarter-notes count-in style. The song start would be expected after the first utterance of the digit "four" at the time at ts=t4+60/T, where t4, is the onset time of the first utterance of "four":

Example 6

Figure 7:
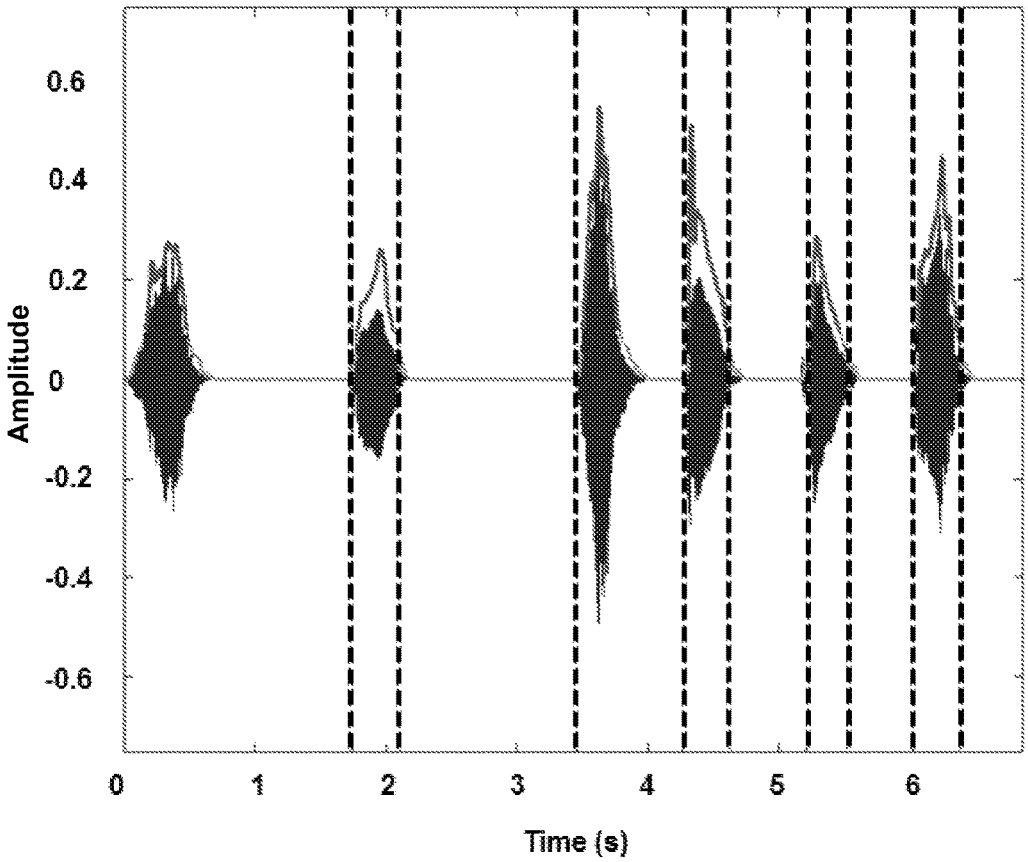
FIG. 7 shows a plot of amplitude versus time. The blue line (lower, clustered line) is for sound-file, and the red line (higher, separated line) is for envelope.

The test of Examples 4 and 5 was repeated but with a 4/4 beat at 70 bpm, 6.86-s start time and count-in style of [1 2| 1 2 3 4]. FIG. 7 shows a plot of amplitude versus time for this 4/4 beat at 70 bpm, 6.86-s start time and count-in style [1 2| 1 2 3 4]. The blue line (lower, clustered line) is for sound-file, and the red line (higher, separated line) is for envelope.

Estimates are as follows:

Estimate @ 3.46 s: Measure: 4/4;
Estimate @ 3.46 s: Count-in style [1 2| 1 2 3 4];
Estimate @ 4.27 s: 6.74-s start time, 72.8 bpm;
Estimate @ 5.21 s: 6.91-s start time, 70.6 bpm; and
Estimate @ 6.02 s: 6.87-s start time, 71.2 bpm.

In this case, and in the cases of Examples 4 and 5, the algorithm ended after the song start ts. Depending on the setup of the sound-capturing device(s) (e.g., the microphone setup), the system can either wait for the song to end (continuous elevated sound pressure from the music signal) and then arm the system again (Start) or re-arm the system immediately (e.g., in case the sound-capturing device for the counting-in speaker is isolated from the music signal, for example in a music studio situation where the musician(s) play(s) with headphones).

Example 7

The system of FIGS. 3 and 4 (with a "count-in" algorithm) was implemented using Matlab, HMM Speech Recognition Tutorial MATLAB code (spturtle.blogspot.com), and Voicebox toolbox (http://www.ee.ic.ac.uk/hp/staff/dmb/voicebox/voicebox.zip)

It should be understood that the examples and embodiments described herein are for illustrative purposes only and that various modifications or changes in light thereof will be suggested to persons skilled in the art and are to be included within the spirit and purview of this application.

All patents, patent applications, provisional applications, and publications referred to or cited herein (including those in the "References" section) are incorporated by reference in their entirety, including all figures and tables, to the extent they are not inconsistent with the explicit teachings of this specification.

REFERENCES

U.S. Pat. No. 3,951,029; Automatic accompaniment system for use with an electronic musical instrument
European Document No. EP1081680; Song accompaniment system
U.S. Pat. No. 4,864,908; System for selecting accompaniment patterns in an electronic musical instrument
U.S. Pat. No. 7,323,630; Automatic performance system
U.S. Pat. No. 5,177,313; Rhythm performance apparatus
U.S. Pat. No. 6,051,771; Apparatus and method for generating arpeggio notes based on a plurality of arpeggio patterns and modified arpeggio patterns
U.S. Pat. No. 4,300,430; Chord recognition system for an electronic musical instrument
U.S. Pat. No. 4,506,580; Tone pattern identifying system
U.S. Pat. No. 8,338,686; System and method for producing a harmonious musical accompaniment
U.S. Pat. No. 4,922,797; Layered voice musical self-accompaniment system
U.S. Pat. No. 6,975,995; Network based music playing/song accompanying service system and method
European Document No. EP 0699333 Intelligent music accompaniment method,
U.S. Pat. No. 5,869,783; Method and apparatus for interactive music accompaniment
U.S. Pat. No. 5,741,992; Musical apparatus creating chorus sound to accompany live vocal sound
U.S. Pat. No. 3,629,480; Rhythmic accompaniment system employing randomness in rhythm generation
International Patent Application No. 2003/032295; Method and device for automatic music generation and applications
International Patent Application No. WO 1995/035562; Automated accompaniment apparatus and method
Braasch, J., Bringsjord, S., Kuebler, C., Oliveros, P., Parks, A., Van Nort, D. (2011) Caira—a Creative Artificially- Intuitive and Reasoning Agent as conductor of telematic music improvisations, Proc. 131th Audio Engineering Society Convention, Oct. 20-23, 2011, New York, N.Y., Paper Number 8546.

Braasch, J., Peters, N., Van Nort, D., Oliveros, P., Chafe, C. (2011) A Spatial Display for Telematic Music Performances, in: Principles and Applications of Spatial Hearing: Proceedings of the First International Workshop on IWPASH (Y. Suzuki, D. Brungart, Y. Iwaya, K. Iida, D. Cabrera, H. Kato (eds.) World Scientific Pub Co Inc, ISBN: 9814313874, 436-451.

J. Braasch, D. Van Nort, P. Oliveros, S. Bringsjord, N. Sundar Govindarajulu, C. Kuebler, A. Parks, *A creative artificially-intuitive and reasoning agent in the context of live music improvisation*, in: Music, Mind, and Invention Workshop: Creativity at the Intersection of Music and Computation, Mar. 30 and 31, 2012, The College of New Jersey, URL: http://www.tcnj.edu/mmi/proceedings.html2012.

D. Van Nort, J. Braasch, P. Oliveros (2009) A system for musical improvisation combining sonic gesture recognition and genetic algorithms, in: Proceedings of the SMC 2009-6th Sound and Music Computing Conference, 23-25 Jul. 2009, Porto, Portugal, 131-136.

Van Nort, D., Oliveros, P., Braasch, J. (2010) Developing Systems for Improvisation based on Listening, in Proc. of the 2010 International Computer Music Conference (ICMC 2010), New York, N.Y., Jun. 1-5, 2010.

Van Nort, D., Braasch, J., Oliveros, P. (2012) Mapping to musical actions in the FILTER system, The 12st International Conference on New Interfaces for Musical Expression (NIME), May 21-23, Ann Arbor, Mich.

Oliveros, P., Panaiotis, "Expanded instrument system (EIS)," in Proc. of the 1991 International Computer Music Conference (ICMC91), Montreal, QC, Canada, 1991, pp. 404-407.

Assayag, G., Bloch, G., Chemillier, M., and Levy, B. (2012). \OMax Home Page, URL http://repmus.ircam.fr/omax/home.

Chalupper, J., Fastl, H. (2002) Dynamic loudness model (DLM) for normal and hearing-impaired listeners. Acta Acustica united with Acustica 88, 378-386.

Cope, D. (1987). An expert system for computer-assisted composition, Computer Music Journal 11(4), 30-46.

Dubnov, S., Non-gaussian source-filter and independent components generalizations of spectral flatness measure. In Proceedings of the International Conference on Independent Components Analysis (ICA2003), 143-148, Porto, Portugal, 2003.

Dubnov, S., McAdams, S., Reynolds, R., Structural and affective aspects of music from statistical audio signal analysis. Journal of the American Society for Information Science and Technology, 57(11):1526-1536, 2006.

Ellis, D. P. W. (1996) Prediction-driven computational auditory scene analysis, Doctoral Dissertation, Massachusetts Institute of Technology.

Friberg, A. (1991). Generative rules for music performance: A formal description of a rule system, Computer Music Journal 15(2), 56-71.

Gamper, D., Oliveros, P., "A Performer-Controlled Live Sound-Processing System: New Developments and Implementations of the Expanded Instrument System," Leonardo Music Journal, vol. 8, pp. 33-38, 1998.

Jacob, B. (1996), Algorithmic composition as a model of creativity, Organised Sound 1(3), 157-165.

Lewis, G. E. (2000) Too Many Notes: Computers, Complexity and Culture in Voyager, Leonardo Music Journal 10, 33-39.

Russell, S., Norvig, P. (2002) Artificial Intelligence: A Modern Approach. Prentice Hall, Upper Saddle River, N.J.

Pachet, F. (2004) Beyond the Cybernetic Jam Fantasy: The Continuator, IEEE Computer Graphics and Applications 24(1), 31-35.

Widmer, G. (1994). The synergy of music theory and AI: Learning multi-level expressive interpretation, Technical Report Technical Report OEFAI-94-06, Austrian Research Institute for Artificial Intelligence.

What is claimed is:

1. A system for accompanying music, comprising:

a sound-signal-capturing device;

a signal analyzer configured to analyze sound signals captured by the sound-signal-capturing device; and an electronic sound-producing component that produces a rhythm section accompaniment, wherein the system is configured such that the rhythm section accompaniment produced by the electronic sound-producing component is modified based on output of the signal analyzer;

wherein the signal analyzer is configured to measure parameters, of music performed by at least one human performer, from the captured sound signals, and wherein the parameters include at least one of loudness, information rate, and roughness, and tension of the music;

wherein the system is configured to make a change, based on the measured parameter, at one or more strategic points in a chord progression of the rhythm section accompaniment produced by the electronic sound-producing component, wherein the change includes at least one of: switching to double time if the information rate of the exceeds an upper threshold; switching to half time if the information rate is lower than a lower threshold: switching to normal time if the information rate returns to a level in between the upper threshold and the lower threshold; adapting the loudness of the rhythm section accompaniment instruments to the loudness and tension curve of the at least one performer; playing outside a predetermined chord structure if the system detects that the at least one performer is performing outside the predetermined chord structure; pausing instruments of the rhythm section accompaniment if the tension or loudness decreases by a predetermined amount and performing 4×4 between the captured music and an instrument of the rhythm section by analyzing a temporal structure of the tension, and wherein the strategic points in the chord progression include at least one of: at the end of a chord structure; or at the end of a number of bars.

2. The system according to claim 1, wherein the system is configured to produce a rhythm section accompaniment to accompany music having fixed or varied chord progressions.

3. The system according to claim 1, wherein the sound-signal-capturing device is a microphone, wherein the signal analyzer is a processor or a computing device, and wherein the electronic sound-producing component is an electronic device having at least one speaker.

4. The system according to claim 1, further comprising a music synthesizer to perform sonification on the rhythm section accompaniment produced by the electronic sound-producing component.

5. A method of providing musical accompaniment, comprising:

playing music within functional range of the sound-signal-capturing device of the system of claim 1; and using the system to provide a rhythm section accompaniment to the played music.

6. The system according to claim 1, wherein the system is configured to recognize a human voice counting in a song and start the rhythm section accompaniment in the right measure and tempo based on the counting of the human voice, wherein the sound-signal-capturing device captures the counting of the human voice, wherein the signal analyzer analyzes the captured counting, and wherein the system further comprises:

a word recognition component to recognize the captured counting; and a count-in algorithm that tags timing and identified digits of the captured counting and uses this combined information to predict, measure, starting point, and tempo for the rhythm section accompaniment based on predetermined count-in styles.

7. The system according to claim 6, wherein the system further comprises either:

a) a first computer-readable medium having computer-executable instructions for performing the count-in algorithm, and a second computer-readable medium having the word recognition component stored thereon; or b) a computer-readable medium having the word recognition component stored thereon, and also having computer-executable instructions for performing the count-in algorithm.

8. The system according to claim 6, wherein the system uses an envelope follower and threshold detector to mark onset of the captured counting to count in the rhythm section accompaniment, and wherein the system uses Boolean Algebra based on different count-in style templates to predict measure, starting point, and tempo for the rhythm section accompaniment.

9. A system for analyzing timing and semantic structure of a verbal count-in of a song, the system comprising:

a sound-signal-capturing device;

a signal analyzer configured to analyze sound signals of a human voice counting in a song captured by the sound-signal-capturing device;

a word recognition system; and a count-in algorithm that tags timing and identified digits of the captured counting and uses this combined information to predict measure, starting point, and tempo for the song based on predetermined count-in styles.

10. The system according to claim 9, wherein the system further comprises either:

a) a first computer-readable medium having computer-executable instructions for performing the count-in algorithm, and a second computer-readable medium having the word recognition component stored thereon; or b) a computer-readable medium having the word recognition component stored thereon, and also having computer-executable instructions for performing the count-in algorithm.

11. The system according to claim 9, wherein the system uses an envelope follower and threshold detector to mark onset of the captured counting to count in the song, and wherein the system uses Boolean Algebra based on different count-in style templates to predict measure, starting point, and tempo for the song.

12. The system according to claim 9, further comprising a plurality of sound-signal-capturing devices and an electronic sound-producing component that plays the song, wherein each signal-capturing device is a microphone, and wherein the electronic sound-producing component is an electronic device having at least one speaker.

13. A method of analyzing timing and semantic structure of a verbal count-in of a song, comprising:

counting in a song within functional range of the sound-signal-capturing device of the system of claim 9; and using the system to analyze timing and semantic structure of the count-in of the song and then being playing the song.

14. A system for accompanying music, comprising:

a sound-signal-capturing device;

a signal analyzer configured to analyze sound signals captured by the sound-signal-capturing device; and an electronic sound-producing component that produces a rhythm section accompaniment, wherein the system is configured such that the rhythm section accompaniment produced by the electronic sound-producing component is modified based on output of the signal analyzer;

wherein the system is configured to make a change, based on a stochastic process, at one or more strategic points in a chord progression of the rhythm section accompaniment produced by the electronic sound-producing component, wherein the change includes at least one of: switching to double time; switching to half time; switching to normal time; changing the loudness of the rhythm section accompaniment instruments; playing outside a predetermined chord structure: pausing instruments of the rhythm section accompaniment; and performing 4×4 between the captured music and an instrument of the rhythm section accompaniment, wherein the stochastic process uses a random generator, wherein, for a given event a threshold of likelihood is adjusted and, if an internally-drawn random number exceeds the threshold of likelihood, a change is made.

15. A method of providing musical accompaniment, comprising:

playing music within functional range of the sound-signal-capturing device of the system of claim 14; and using the system to provide a rhythm section accompaniment to the played music.

16. The system according claim 14, wherein the system is configured to make a change based on the stochastic process in combination with the measured parameters, such that values of the measured parameters affect the likelihood of the stochastic process causing a change to be made.

17. The system according to claim 14, wherein the system is configured to give an impulse and make an initiative change in the rhythm section accompaniment based on a stochastic process, wherein the initiative change is at least one of: changing a style pattern or taking a different pattern within the same style; pausing instruments of the rhythm section accompaniment; changing to double time, half time, or normal time; leading into a theme or a solo; playing 4×4; and playing outside.

18. A system for accompanying music, comprising:

a sound-signal-capturing device;

a signal analyzer configured to analyze sound signals captured by the sound-signal-capturing device; and an electronic sound-producing component that produces a rhythm section accompaniment, wherein the system is configured such that the rhythm section accompaniment produced by the electronic sound-producing component is modified based on output of the signal analyzer;

wherein the system is configured to make a change, based on a machine learning algorithm, at one or more strategic points in a chord progression of the rhythm section accompaniment produced by the electronic sound-producing component, wherein the change includes at least one of: switching to double time: switching to half time; switching to normal time; changing the loudness of the rhythm section accompaniment instruments; playing outside a predetermined chord structure; pausing instruments of the rhythm section accompaniment, and performing 4×4 between the captured music and an instrument of the rhythm section accompaniment, wherein the machine learning algorithm uses a random generator, wherein, for a given event, a threshold of likelihood is adjusted and, if an internally-drawn random number exceeds the threshold of likelihood, a change is made.

19. A method of providing musical accompaniment, comprising:

playing music within functional range of the sound-signal-capturing device of the system of claim 18; and using the system to provide a rhythm section accompaniment to the played music.

20. The system according to claim 18, wherein the system is configured to make a change based on the machine learning algorithm in combination with the measured parameters, such that values of the measured parameters affect the likelihood of the machine learning algorithm causing a change to be made.

21. The system according to claim 18, wherein the system is configured to give an impulse and make an initiative change in the rhythm section accompaniment based on a machine learning algorithm, wherein the initiative change is at least one of: changing a style pattern or taking a different pattern within the same style; pausing instruments of the rhythm section accompaniment; changing to double time, half time, or normal time; leading into a theme or a solo; playing 4×4; and playing outside.

* * * * *